US005638747A

United States Patent [19]

Peng

[11] Patent Number: 5,638,747

[45] Date of Patent: Jun. 17, 1997

[54] RUBBISH CONTAINER WITH AUTOMATIC COMPRESSING MECHANISM

[76] Inventor: Hsin-chih Peng, No. 748 Chien-hsing Road, Taichung, Taiwan

[21] Appl. No.: 644,366

[22] Filed: May 10, 1996

[51] Int. Cl.[6] ..... B30B 15/00

[52] U.S. Cl. ..... 100/45; 100/52; 100/73; 100/99; 100/102; 100/221; 100/226; 100/270

[58] Field of Search ..... 100/45, 49, 52, 100/73, 99, 102, 221, 226, 229 A, 270

[56] References Cited

U.S. PATENT DOCUMENTS

| | | | |
|---|---|---|---|
| 2,892,396 | 6/1959 | Ferguson, II et al. | 100/102 |
| 3,413,913 | 12/1968 | Smedlund | 100/221 |
| 3,495,376 | 2/1970 | Lundgren | 100/221 |
| 3,589,277 | 6/1971 | Gray et al. | 100/221 |
| 3,808,967 | 5/1974 | Fair et al. | 100/221 |
| 3,926,107 | 12/1975 | Dunlap et al. | 100/73 |
| 4,212,240 | 7/1980 | Lee et al. | 100/52 |
| 4,241,652 | 12/1980 | Smedlund | 100/49 |
| 4,735,136 | 4/1988 | Lee et al. | 100/52 |
| 4,996,918 | 3/1991 | Carter et al. | 100/221 |
| 5,490,455 | 2/1996 | Conti et al. | 100/221 |

FOREIGN PATENT DOCUMENTS

| | | | |
|---|---|---|---|
| 195610 | 6/1957 | Austria | 100/226 |
| 7703661 | 10/1978 | Netherlands | 100/226 |

*Primary Examiner*—Stephen F. Gerrity
*Attorney, Agent, or Firm*—Bacon & Thomas

[57] ABSTRACT

A rubbish container with automatic compressing mechanism mainly including a housing, a plurality of rubbish bins positioned inside the housing to collect sorted rubbish, movement control channels provided in the housing to support a transversely extended top board, and an automatic compressing mechanism mounted on the top board. A motor is connected to one end of one of the movement control channels to rotate a threaded rod therein, so that the top board connected to the threaded rod and the compressing mechanism on the top board are brought to translate along the movement control channels to and fro in the housing over the rubbish bins. The compressing mechanism has a motor to drive a compressing member and a compressing plate connected to a lower end of the compressing member to move up and down, compressing rubbish collected in the rubbish bins to a reduced volume. Fire extinguisher and deodorizing units can be provided in the housing to permit the rubbish container to be safely used and to minimize the bad odors escaping from the rubbish container.

6 Claims, 6 Drawing Sheets

RUBBISH CONTAINER WITH AUTOMATIC COMPRESSING MECHANISM

BACKGROUND OF THE INVENTION

1. Field of the Invention:

The present invention relates to a rubbish container with automatic compressing mechanism, and more particularly to a rubbish container with automatic compressing mechanism which facilitates the dumping and compression of collected rubbish so that more rubbish can be collected and received in the rubbish container. In addition, the rubbish container is provided with anti-septic and deodorizing means.

2. Description of the Prior Art

The disposal of rubbish has long been a common problem for all local governments. Land must be requisitioned to bury million tons of rubbish, people residing around the land proposed for rubbish bury yard must be satisfied, existed rubbish bury yards and related personnel must be well managed. However, what can be done by local environmental protection authorities is, at least for the time being, to provide as many as possible dustbins 11 and/or garbage containers 12, as those shown in FIG. 1.

As shown, the dustbin 11 is a hollow container and is usually positioned at roadsides. Labels are attached to an outer side of the dustbin 11 to indicate the type of rubbish to be collected by the dustbin 11, such as dustbin for reusable rubbish and dustbin for non-reusable rubbish. Since such dustbin 11 has only limited capacity, larger rubbish container 12 is developed. Rubbish container 12 as shown in FIG. 1 is usually made of cast iron and is therefore bulky, heavy, and not easily movable. Both of the dustbin 11 and the rubbish container 12 have the following disadvantages:

a) Most people ignore the labels on the dustbins 11 or the rubbish containers 12 for separating reusable rubbish from non-reusable rubbish. The policy of rubbish sortation is therefore not easily carried out.

b) Most of such dustbins or rubbish containers are not used in a covered condition. Bad odors of septic rubbish escaping from the dustbins or rubbish containers inevitably spoil the surroundings.

c) Such non-covered dustbins and rubbish containers positioned at public places or scenic areas will frequently adversely affect the good environment due to overflowed rubbish.

d) Such non-covered dustbins and rubbish containers often become the good places for multiplying bacteria and vermins and directly endanger the health of neighboring residents.

It is therefore tried by the inventor to develop a rubbish container with automatic compressing mechanism to eliminate the above disadvantages existed in the conventional dustbins and rubbish containers.

SUMMARY OF THE INVENTION

A primary object of the present invention is to provide a rubbish container with automatic compressing mechanism which has a housing into which a plurality of sorted-rubbish bins are sequentially positioned. A compressing member translates along sliding rails over the rubbish bins. A compressing plate connected to a lower end of the compressing member is lowered when a motor of the compressing mechanism is started, such that the compressing plate may firmly compress rubbish collected in a target rubbish bin and then be moved to and over the next rubbish bin requiring compression. The compressing mechanism can be moved to and fro over the rubbish bins to automatically compress the rubbish in the rubbish bins of the container.

Another object of the present invention is to provide a rubbish container with automatic compressing mechanism in which the rubbish bins are provided with sensors and compressing control switches to detect the level of rubbish in the rubbish bins. When the rubbish in a bin reaches a predetermined level, the compressing plate is caused to move over the target rubbish bin and to compress the rubbish under controlled pressure, permitting the rubbish bin to receive increased amount of rubbish.

A further object of the present invention is to provide a rubbish container with automatic compressing mechanism, in the housing of which deodorizing means is provided so that bad odors escaping from the rubbish can be removed and the multiplicatin of bacteria can be suppressed.

A still further object of the present invention is to provide a rubbish container with automatic compressing mechanism of which the rubbish bins are positioned in the completely closed housing to avoid the multiplication of bacteria and vermins in the rubbish.

BRIEF DESCRIPTION OF THE DRAWINGS

The detailed structure, applied principles, function and operation of the present invention can be best understood by referring to the following detailed description of the preferred embodiments and the accompanying drawings, wherein.

DETAILED DESCRIPTION OF THE PREFERRED EMBODIMENTS

Figure 1A:
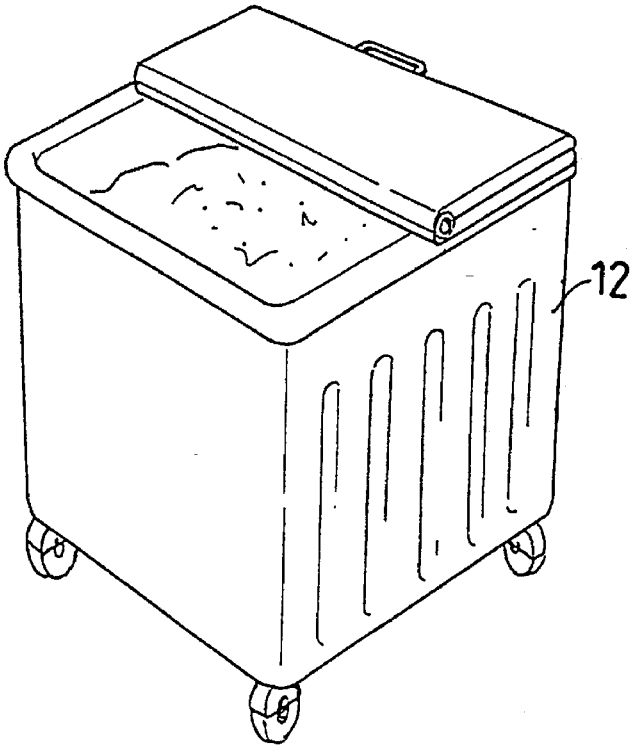
FIG. 1A(PRIOR ART)
FIGS. 1A and 1B illustrate the conventional dustbin and rubbish containers.
Figure 1B:
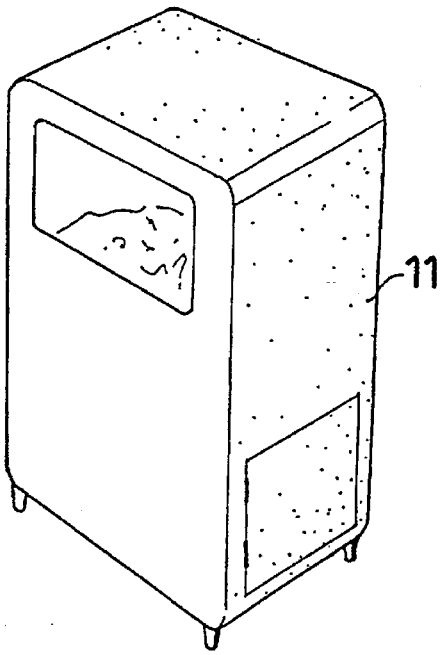
FIG. 1B(PRIOR ART)
Figure 2:
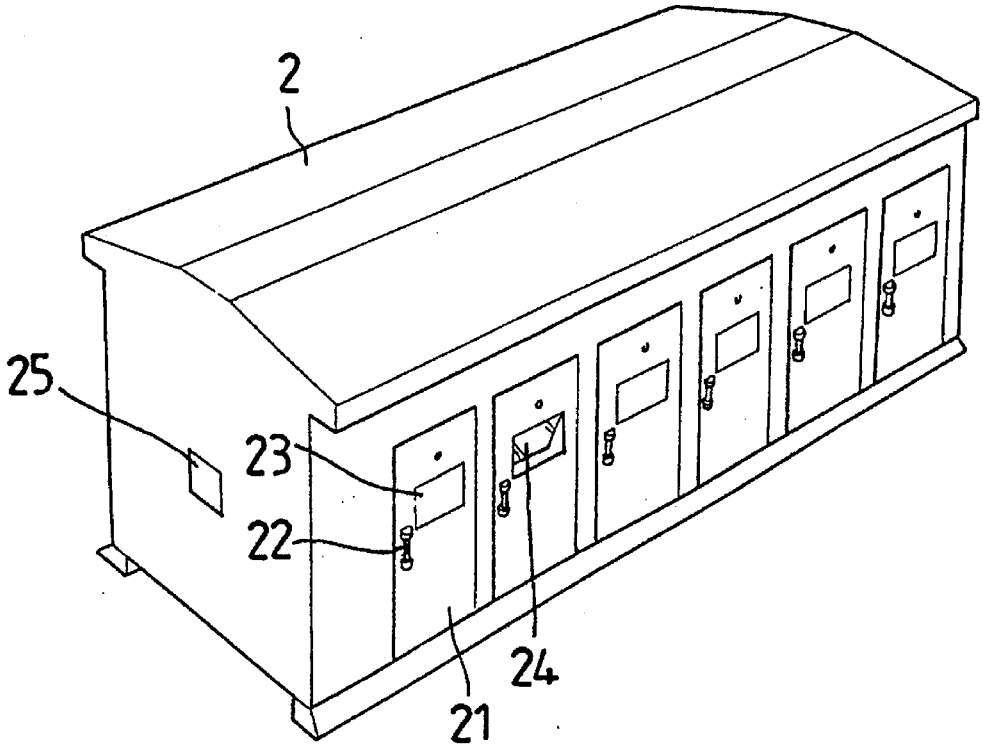
FIG. 2 is a perspective view showing the appearance of the rubbish container according to the present invention.

Please refer to FIG. 2. The present invention relates to a rubbish container with automatic compressing mechanism. The rubbish container includes a housing 2 having a plurality of doors 21 formed on a front wall thereof. Each door 21 is provided at proper positions with a handle 22 and a dump opening 23. The opening 23 each is provided with a pivotally openable panel 24 the opening of which is electrically controllable. A power supply control box 25 is provided to one side wall of the housing 2. A control circuit (not shown) for controlling an overall actuation of the present invention is provided in the power supply control box 25.

Figure 3:
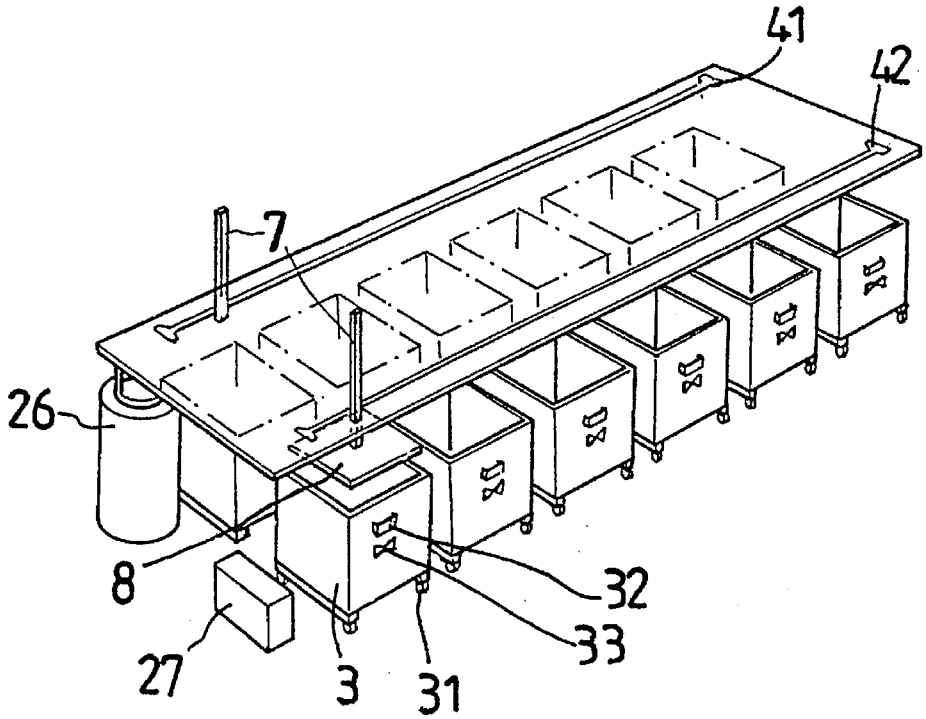
FIG. 3 is a perspective view showing the internal structure of the rubbish container of the present invention.
Figure 4:
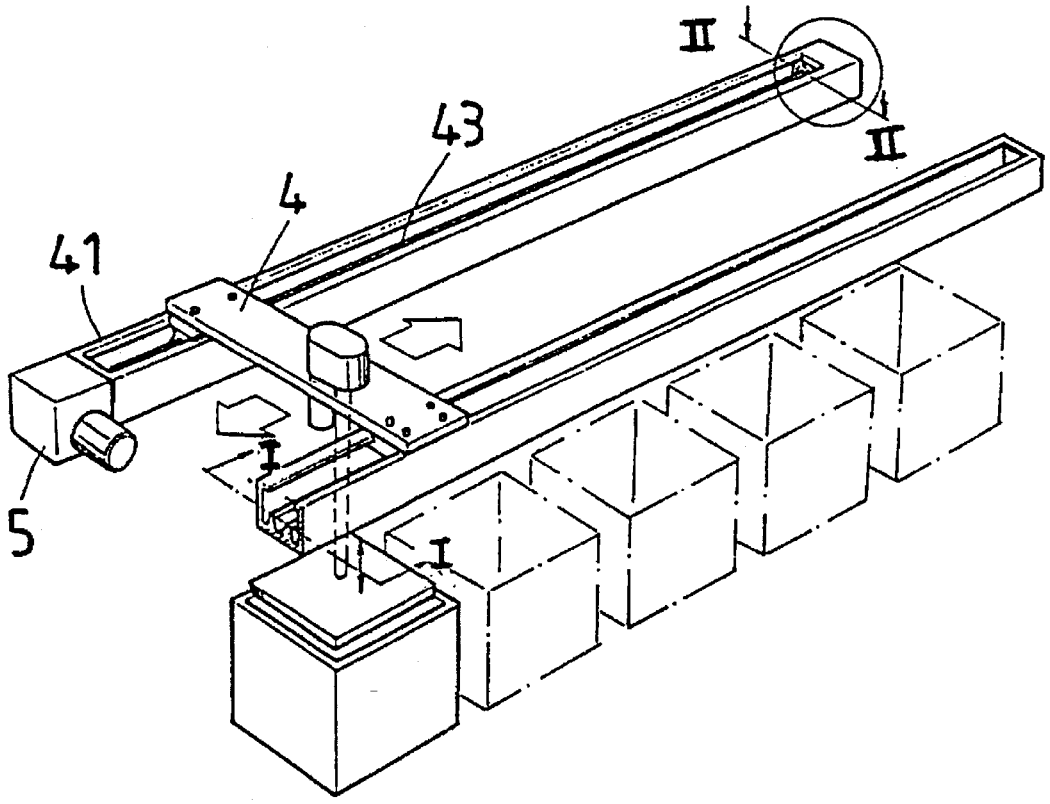
FIG. 4 is a fragmentary perspective view showing the structure of the movement control channel and the sliding channel of the present invention.
Figure 4A:
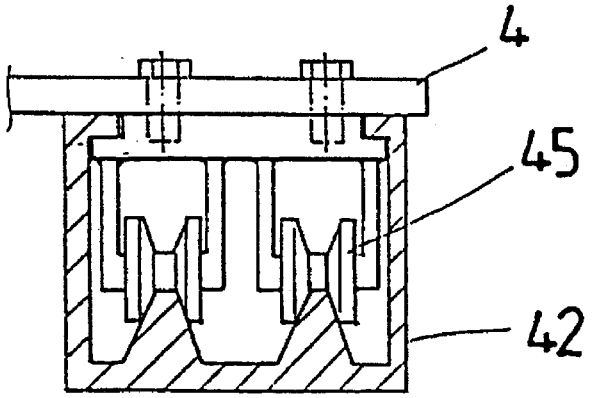
FIG. 4A is a cross-sectional view taken along line I—I in FIG. 4.
Figure 4B:
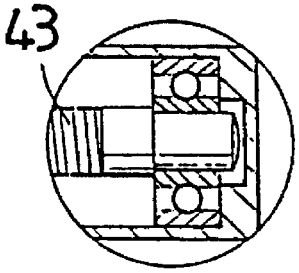
FIG. 4B is a cross-sectional view taken along line II—II in FIG. 4.
Figure 5:
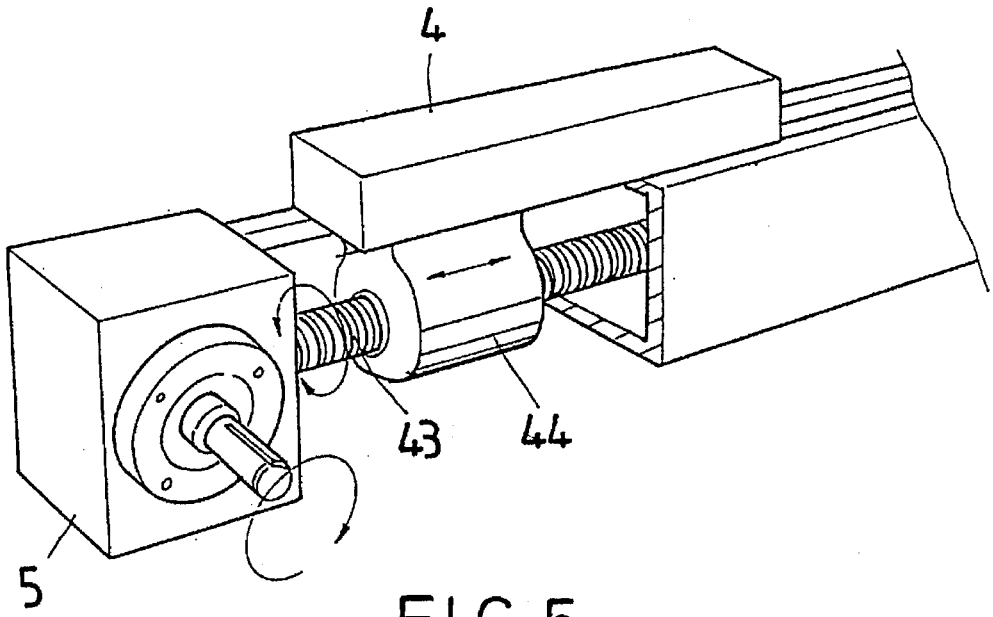
FIG. 5 is a fragmentary perspective view with a part thereof cutaway to better show the structure of the movement control channel.

Please refer to FIG. 3. A plurality of sorted-rubbish bins 3 are positioned inside the housing 2. Each sorted-rubbish bin 3 is provided at a bottom with wheels 31 and at a front outer wall with a hook receiver 32 and a hook holder 33. A top board 4 is provided over the sorted- rubbish bins 3 to transversely extend between and over a movement control channel 41 and a sliding channel 42. Please now refer to FIGS. 4 and 5 at the same time. The movement control channel 41 includes a threaded rod 43 longitudinally extending a full length of the movement control channel 41. The top board 4 is provided at an underside to one end with a sliding collar 44 through which the threaded rod 43 extends so as to connect the top board 4 to the movement control channel 41. A motor 5 is provided to one outer end of the movement control channel 41 to rotate the threaded rod 43. The top board 4 is also provided at the underside to another end with rollers 45 so as to slidably move along rails formed in the sliding channel 42.

Figure 6:
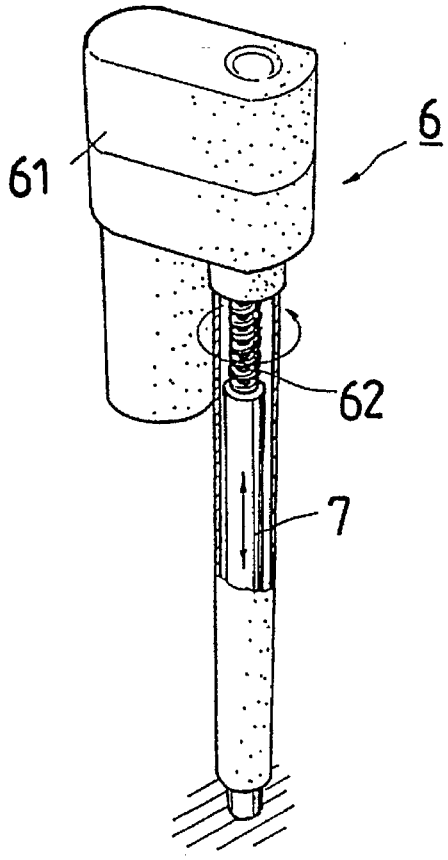
FIG. 6 is a perspective view showing the spiral compressing mechanism adopted in the present invention.

Please further refer to FIG. 6. A spiral compressing mechanism 6 is mounted on the top board 4. The spiral compressing mechanism 6 includes a motor 61 disposed at a top of the mechanism 6 and capable of being actuated through the control circuit in the power supply control box 25, a threaded stem 62 rotatable by the motor 61, a compressing member 7 being fitly put around the threaded stem 62, and a compressing plate 8 connected to a bottom end of the compressing member 7. The threaded stem 62 is driven by the motor 61 to rotate and thereby drives the compressing member 7 and the compressing plate 8 to move up and down over a selected sorted-rubbish bin 3, tightly compressing the rubbish collected in the target sorted-rubbish bin 3.

Figure 7:
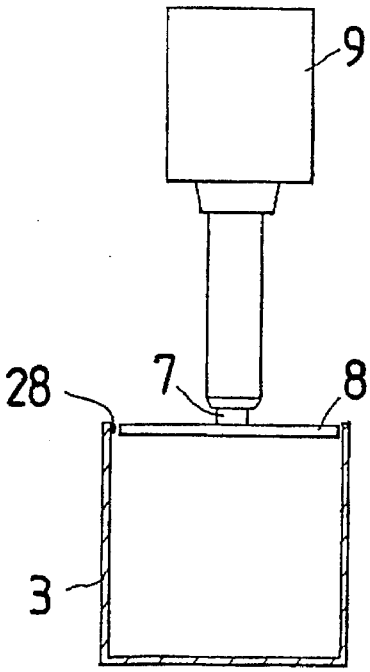
FIG. 7 shows another embodiment of the spiral compressing mechanism adopted in the present invention.

Please refer to FIG. 7 in which another embodiment of the compressing mechanism 6 is shown. A sensor 28 is provided to each sorted-rubbish bin 3 near a top edge thereof for detecting a full-level condition of the rubbish bin 3. When the rubbish bin 3 is detected by the sensor 28 as in the full-level condition, the dump opening panel 24 of the door 21 corresponding to the full rubbish bin 3 is closed through a control circuit. For the purpose of safety in use, the control circuit can be so designed that the motor 61 and accordingly the spiral compressing mechanism 6 are disabled when any one of the panels 24 is opened. Moreover, since the movement of the top board 4 is controlled by the motor 5 connected to one end of the movement control channel 41, it is possible to move the top board 4 and accordingly the compressing plate 8 of the spiral compressing mechanism 6 to a position over and between two sorted-rubbish bins 3 when the spiral compressing mechanism 6 is disabled. By this way, dangers caused by an incorrect operation of the spiral compressing mechanism 6 can be avoided. Since the design of the control circuit is not in the scope of the present invention, it is not particularly described herein.

To suppress the possible multiplication of bacteria and vermins in the rubbish as well as the possible bad odors escaping from the rubbish collected in the sorted-rubbish bins 3, a deodorizing means 27 can be mounted inside the housing 2. Moreover, to ensure the safe use of the present invention, a fire extinguisher 26 or the like may be positioned inside the housing 2, too.

The hook receiver 32 and the hook holder 33 provided to each sorted-rubbish bin 3 are designed to facilitate the moving and dumping of the sorted-rubbish bins 3 by using some hooking means.

The multiple rubbish bins 3 simultaneously provided in the housing 2 allow general public to conveniently dump the sorted rubbish into the correct rubbish bins 3 via the dump openings 23 formed on the rubbish container. The motor 5 can be actuated by the control circuit in the control box 25 to drive the top board 4 to translate over the rubbish bins 3, allowing the spiral compressing mechanism 6 to locate above a rubbish bin 3. And then, the spiral compressing mechanism 6 can be actuated through the control circuit to lower down its compressing member 7 and compressing plate 8 to compress the rubbish collected in the target rubbish bin 3 into a reduced volume, such that much more rubbish can be collected in the rubbish bins 3. The sensor 28 for detecting the full-level condition of the rubbish bin 3 is helpful in enabling the use of the present invention in a manner meeting the requirement of public sanitation so as to protect the surrounding environment.

As shown in FIG. 7, the spiral compressing mechanism 6 can also be replaced with an hydraulic cylinder 9. The hydraulic cylinder 9 may be predefined with a compressing force of the compressing member 7 to compress the rubbish, so that the rubbish can be most adequately compressed.

Figure 8:
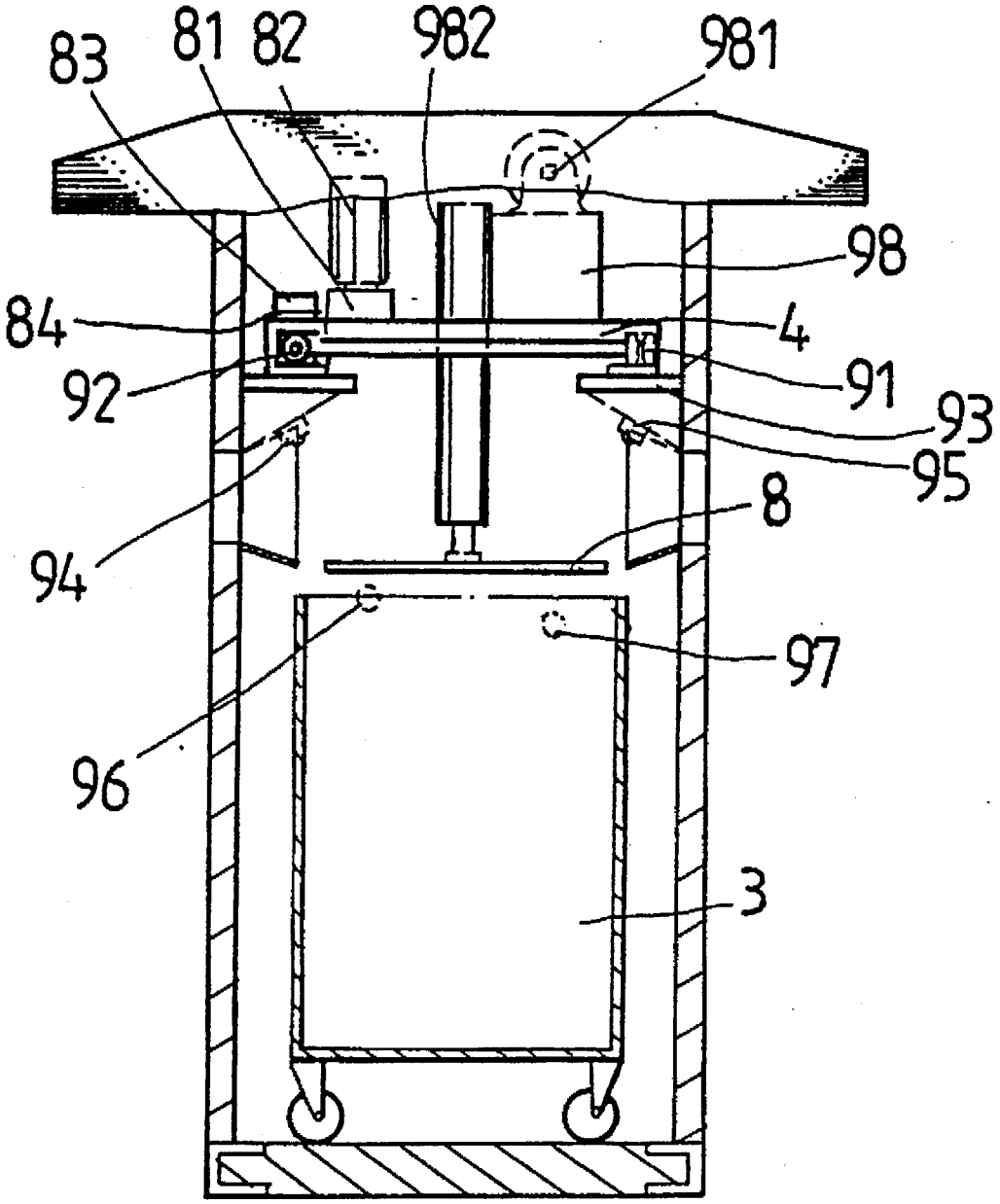
FIG. 8 shows still another embodiment of the sprial compressing mechanism adopted in the present invention.

FIG. 8 illustates a further embodiment of the present invention. In this embodiment, the top board 4 is provided at a bottom side at two outer ends with rollers 91 to roll along rails 92. The rails 92 are located on two supporting frames 93 fixed to the back and the front walls of the rubbish container. Photoelectric sensors 94, 95 electrically connected to the control circuit are respectively mounted below the supporting frames 93 to detect and sense a full-level point 96 and a compressing point 97 in each rubbish bin 3, respectively. When the collected rubbish in a rubbish bin 3 reaches the compressing point 97 and is detected by the sensor 95 which in turn sends signal to the control circuit, a compressing mechanism is actuated through the control circuit to compress the rubbish in the target rubbish bin 3.

The compressing mechanism adopted in this embodiment is mounted on the top board 4 and includes an oil tank, a pump 98, a motor 981 mounted on the pump 98, and a compressing member 982 driven by the motor 981. The compressing member 982 also has a compressing plate 8 connected to a bottom end thereof. A driving mechanism is provided on the top board 4 opposite to the compressing mechanism to control the movement of the top board 4. The driving mechanism includes a speed reducer 81, a motor 82 disposed above the speed reducer 81, a gear set 83 provided to a power output end of the speed reducer 81, and a rack 84 with which the gear set 83 is engaged.

When the photoelectric sensors 94, 95 respectively detect that the full-level point 96 and the compressing point 97 are reached by the collected rubbish in a specific rubbish bin 3, the speed reducer 81 is informed and actuated by the control circuit to move the top board 4 to and over the full rubbish bin 3. Then, the compressing member 982 is driven by the motor 981, which is informed and actuated by the control circuit, to lower down and compress the collected rubbish in the target rubbish bin 3.

With the above arrangements, the compressing mechanism of the rubbish container of the present invention can be electrically moved to and fro over the serially positioned rubbish bins in the container and be lowered to compress rubbish collected in the bins when the rubbish reaches a full-level point in the bins. By this way, more rubbish can be collected in the bins without overflowing from the bins to adversely affect the environment. Moreover, bacteria, vermins and bad odors from the rubbish container can be effectively suppressed.

It is to be understood that the form of the invention shown and disclosed is to be taken as a preferred embodiment of the invention and that various changes in the shape, size, and arrangement of parts may be resorted to without departing from the spirit of the invention or the scope of the subjoined claims.

What is claimed is:

1. A rubbish container with automatic compressing mechanism, comprising:

a housing;

a plurality of rubbish bins serially positioned inside said housing for collecting rubbish;

a movement control channel provided in said housing on a back inner wall of said housing, said movement control channel having a threaded rod being driven to rotate by a first motor;

a sliding channel provided in said housing on a front inner wall thereof corresponding to said movement control channel;

a top board supported on and extending between said movement control channel and said sliding channel;

said top board having a sliding collar connected to a bottom side near one end thereof such that said threaded rod of said movement control channel threads through said sliding collar; said top board also having rollers connected to said bottom side near another end thereof opposite to said sliding collar;

a spiral compressing mechanism mounted on said top board;

said spiral compressing mechanism further comprising a threaded stem, a compressing member fitly put around said threaded stem, a compressing plate connected to a bottom end of said compressing member, and a second motor located at a top portion of said compressing mechanism for rotating said threaded stem which in turn causes said compressing member and said compressing plate to move up and down to compress sorted-rubbish collected in said rubbish bins; and a power supply control box mounted on said housing and having a control circuit provided therein for controllong the actuation of said first and said second motors.

2. A rubbish container with automatic compressing mechanism as claimed in claim 1, wherein said housing is formed on a front wall with a plurality of doors, each of said doors being provided with a dump opening and an electrically controlled openable panel pivotally connected to said dump opening; and said rubbish bins each being provided with a sensor for detecting a full-level condition of said rubbish bins, said sensor, when detects a full-level condition of a corresponding rubbish bin, actuating a switch to close said panel of said dump opening on said housing corresponding to said full rubbish bin.

3. A rubbish container with automatic compressing mechanism as claimed in claim 1, wherein said housing is provided therein with a fire extinguisher and deodorizing means.

4. A rubbish container with automatic compressing mechanism as claimed in claim 1, wherein said rubbish bins are provided at a bottom side with wheels and at a front outer wall with a hook receiver and a hook holder.

5. A rubbish container with automatic compressing mechanism as claimed in claim 1, wherein said spiral compressing mechanism is actuated by a hydraulic cylinder.

6. A rubbish container with automatic compressing mechanism comprising:

a housing;

a plurality of rubbish bins serially positioned inside said housing for collecting rubbish;

two supporting frames fixed to a back and a front inner walls of said housing, each of said supporting frames being provided on a top surface with a rail;

a top board supported on and extending between said two rails provided on said top surface of said two supporting frames and having rollers provided at a bottom side thereof for said top board to slide on said two rails;

a plurality of sets of photo-electric sensors separately provided below said two supporting frames to respectively detect a full-level point and a compressing point of each of said rubbish bins;

a compressing mechanism mounted on said top board and further comprising an oil tank, a pump, a first motor mounted on said pump, and a compressing member driven by said first motor, said compressing member including a compressing plate connected to a bottom end thereof; and a driving mechanism provided on said top board opposite to said compressing mechanism for controlling the movement of said top board, said driving mechanism including a speed reducer, a second motor disposed above said speed reducer for actuating said speed reducer and moving said top board, a gear set provided to a power output end of said speed reducer, and a rack with which said gear set is engaged; and a power supply control box mounted on said housing and having a control circuit provided therein, said control circuit being capable of receiving signals from said photoelectric sensors to control the actuation of said first and said second motors.

* * * * *